United States Patent [19]

Straitz, III

[11] 4,003,693

[45] Jan. 18, 1977

[54] FLARE STACK GAS BURNER

[75] Inventor: John F. Straitz, III, Jenkintown, Pa.

[73] Assignee: Combustion Unlimited Incorporated, Elkins Park, Pa.

[22] Filed: Mar. 6, 1975

[21] Appl. No.: 555,974

[52] U.S. Cl. ..... 431/202; 23/277 C; 239/403; 431/183; 431/351

[51] Int. Cl.[2] ..... F23D 13/20

[58] Field of Search ..... 431/202, 283, 285, 183, 431/185, 351; 23/277 C; 239/403, 405, 406

[56] References Cited

UNITED STATES PATENTS

| | | | |
|---|---|---|---|
| 1,206,153 | 11/1916 | Smith | 239/403 |
| 2,096,946 | 10/1937 | Van Law | 431/185 |
| 2,204,719 | 6/1940 | Zink | 431/284 |
| 3,358,736 | 12/1967 | Reed et al. | 431/285 |
| 3,539,285 | 11/1970 | Zink et al. | 431/202 |
| 3,796,209 | 3/1974 | Luff | 431/183 |
| 3,864,072 | 2/1975 | Abernathy et al. | 431/285 |
| 3,893,810 | 7/1975 | Lientz | 23/277 C |
| 3,904,351 | 9/1975 | Smith et al. | 431/202 |
| 3,905,752 | 9/1975 | Miller | 431/183 |

*Primary Examiner*—Carroll B. Dority, Jr.
*Attorney, Agent, or Firm*—Zachary T. Wobensmith, 2nd; Zachary T. Wobensmith, III

[57] ABSTRACT

A flare stack gas burner for waste combustible gas from oil refineries, chemical plants, oil production rigs, LPG and other marketing terminals, pipe lines and the like is disclosed which includes a stack with a centrally disposed combustible gas delivery pipe having a divider at the top with arms for upward delivery of the combustible waste gas through a plurality of radial slots to a mixing space, air under pressure being supplied to the stack and between the arms to the mixing space, a rotary diffuser being provided above the mixing space for directing the combustible gas-air mixture for combustion thereabove in a cylindrical or flaring frusto-conical vortex for smokeless combustion. Suitable gas pilots and igniters are employed. An optional flaring frusto-conical shield may be provided for a portion of the burning vortex where required.

4 Claims, 5 Drawing Figures

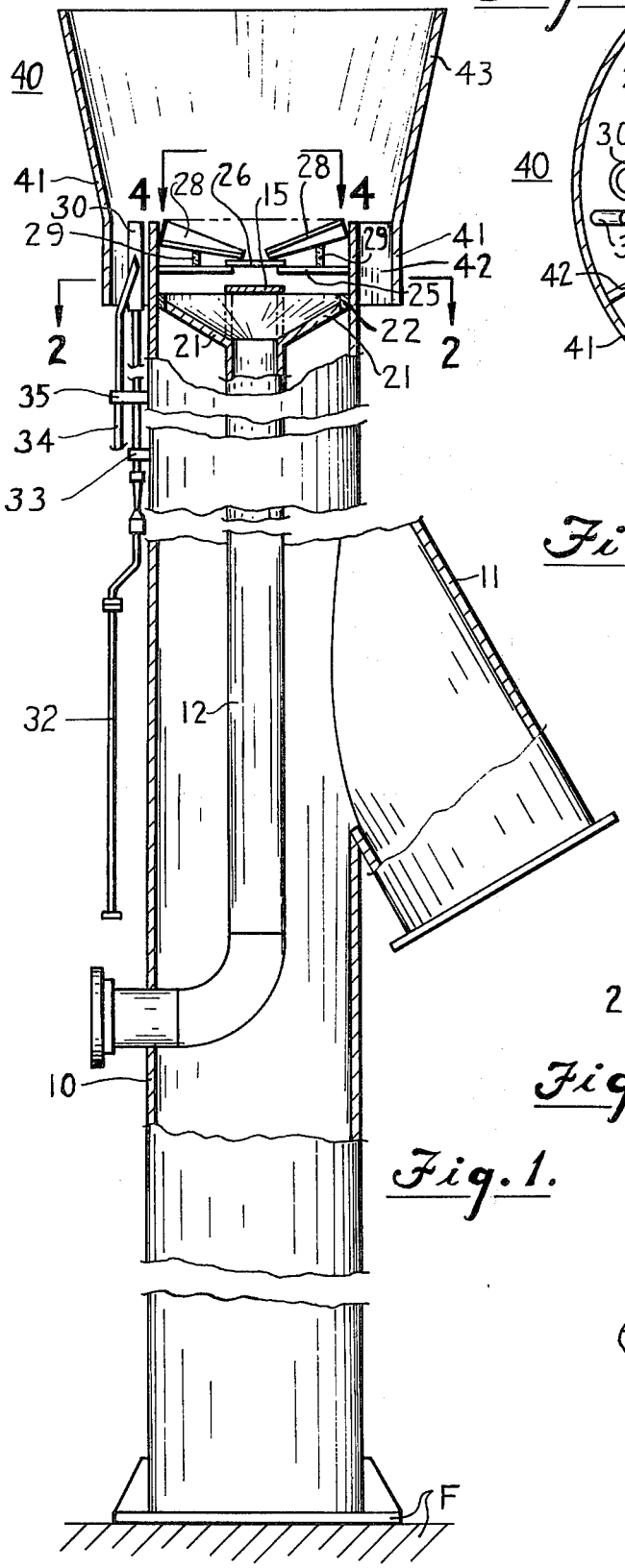
Fig. 1.
Fig. 2.
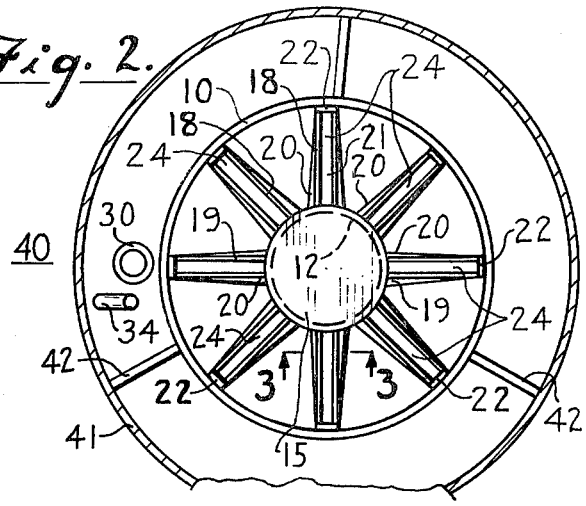
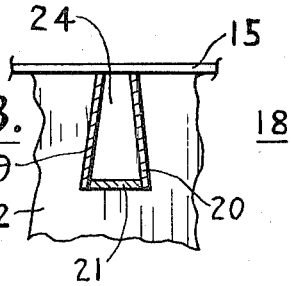
Fig. 3.
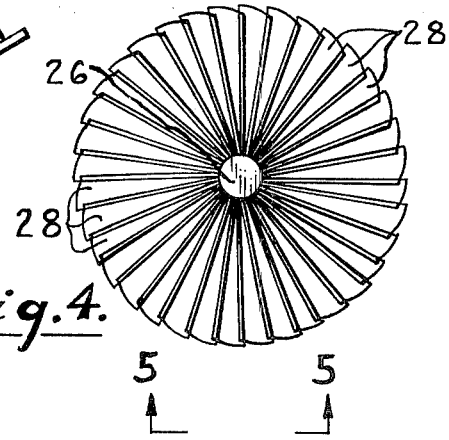
Fig. 4.
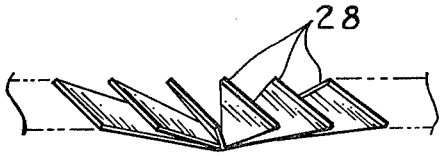
Fig. 5.

FLARE STACK GAS BURNER

BACKGROUND OF THE INVENTION

1. Field of the Invention

This invention relates to flare stack gas burners for combustible waste gas from various sources and for smokeless burning without steam.

2. Description of the Prior Art

In industrial operations and particularly in the operation of oil refineries, chemical plants, oil production rigs, LPG and other marketing terminals, pipe lines and other combustible waste gas sources it becomes necessary from time to time to burn various quantities of combustible gaseous materials with the combustion carried out without discharge of unburned carbon particles in the form of smoke into the atmosphere.

Various flare stack gas burners have heretofore been proposed for the combustion of waste gas but many of these had serious limitations, particularly because of the difficulty of designing a structure that will operate smokelessly.

In addition, at some locations, no adequate supply of steam is available for smoke suppression as has been used in many flare stack burners. Other considerations, such as climate, may also preclude the use of steam for smoke suppression.

Among the burners heretofore proposed are those shown in the U.s. patents to Verner et al., U.S. Pat. No. 2,761,496, Webster, et al. U.S. Pat. No. 2,891,607; Shellentrager, U.S. Pat. No. 2,506,972; Rodman, U.S. Pat. No. 2,537,091; Zink et al. U.S. Pat. No. 2,779,399; Campbell et al., U.S. Pat. No. 2,802,521; Zink et al., U.S. Pat. No. 3,143,424; and in Canadian Pat. No. 691,894, to Williams, and in British Pat. No. 795,664 to British Petroleum Co., et al.

None of these burners has proven wholly satisfactory in providing for smokeless burning of waste combustible gas under varied conditions encountered at refinery locations.

In my pior U.S. Pat. No. 3,822,985 a flare stack gas burner is shown that has proven to be satisfactory in providing combustion in a vortex but the present invention has greater adaptability.

SUMMARY OF THE INVENTION

In accordance with the invention a flare stack gas burner is provided suitable for the burning of combustible waste gas from a variety of sources which includes a stack with a central combustible gas delivery pipe having a divider at the top with radial arms for upward delivery of combustible gas through a plurality of radial slots to a mixing space or chamber to which air under pressure supplied to the stack is also delivered between the radial arms, a fixedly mounted rotary diffuser being provided above the mixing space for directing the combustible gas-air mixture for combustion thereabove in a cylindrical or flaring frusto-conical vortex for smokeless combustion. An optional flaring frusto-conical shield may be provided for a portion of the burning vortex.

It is the principal object of the invention to provide a flare stack gas burner which is effective for the combustion of waste combustible gases free from smoke.

It is a further object of the invention to provide a flare stack gas burner in which the combustible waste gas is delivered at the top of the stack and admixed with air in an improved manner. for smokeless combustion.

It is a further object of the invention to provide a flare stack gas burner in which the combustion is effected in an ascending cylindrical or flaring frusto-conical vortex with adequate air to avoid smoke formation.

It is a further object of the invention to provide a flare stack gas burner of the character aforesaid in which the component parts are simple, sturdy, trouble free, require a minimum of maintenance, and which is mqre effective in its burning of the waste gas than the flare burners heretofore available.

Other objects and advantageous features of the invention will be apparent from the description and claims.

BRIEF DESCRIPTION OF THE DRAWINGS

The nature and characteristic features of the invention will be readily understood from the following description taken in connection with the accompanying drawings forming part hereof, in which:

FIG. 1 is a view partly in elevation and partly in vertical section of a flare stack in accordance with the invention;

FIG. 2 is a horizontal sectional view of the flare stack of FIG. 1 taken approximately on the line 2—2 of FIG. 1;

FIG. 3 is a fragmentary vertical sectional view taken approximately on the line 3—3 of FIG. 2;

FIG. 4 is a top plan view as seen from the line 4—4 of FIG. 1; and

FIG. 5 is a fragmentary view as seen from the line 5—5 of FIG. 4.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings, a vertical stack pipe 10 is shown, circular in horizontal cross section and supported on a suitable foundation F and near the bottom of which is mounted an air inlet pipe 11 with an air blower (not shown) and a damper (not shown) to supply air into the interior of the stack pipe 10 for combustion of the waste gas.

The pipe 10 is preferably fabricated of steel and coated to recuce rusting, and in a specific embodiment may be of height of the order of sixty feet and an outside diameter of the order of forty two inches.

The stack pipe 10 has, in spaced relation thereto, a centrally disposed interior gas delivery pipe 12 with its lower terminus communicating with the supply of combustible waste gas under pressure to be burned. The pipe 12 is closed at the top by an annular closure plate 15 and in a specific embodiment may have a diameter of the order of eight inches.

The pipe 12 has extending outwardly therefrom a plurality of fixed arms 18. The arms 18 (see FIGS. 2 and 3) are shown as made with converging side wall plates 19 and 20, closed at the bottom by a bottom wall 21 and at the outer end by an end wall 22.

The plates 19 and 20 are separated at the top to provide a gas delivery slot 24 for vertically upward combustible gas delivery to a mixing space or chamber 25 and at their inner ends the arms 18 have their interiors in communication with the pipe 12.

In larger flare stacks, in order to prevent downflow in the interior of the gas delivery pipe 12, whether by external wind conditions or contraction by cooling of hot gas in the system, and also to reduce fluid oscillations, a fluidic diode (not shown) such as that shown in my U.S. Pat. No. 3,730,673, dated May 1, 1973, for Vent Seal, can be employed in the gas delivery pipe 12.

The stack pipe 10, at the upper end of the mixing space or chamber 25, is provided with a central support plate 26 carried on a supporting spider 27 extending to and secured to the stack pipe 10. A plurality of fixed radially extending inclined or tilted diffuser vanes 28, are provided, supported at their inner supports by the plate 26, at their outer ends by the stack 10 and intermediate their ends by struts 29. The vanes 28 impart a vortex motion to the combustible gas and air advanced therethrough from the mixing space 25 for combustion thereabove.

A plurality of gas pilots 30 are provided with their heads or upper termini at the top of the stack pipe 10. The pilots 30 can be of the venturi air inspirating type and connected by a pipe 32 to a source of supply of combustible pilot gas. The gas pilots 30 can be supported by brackets 33 secured to the pipe 10.

In order to ignite the gas pilots 30, an igniter pipe 34 is provided through which a gas flame is directed when desired. The igniter pipe 34 can be supported by a bracket 35 secured to the pipe 10.

In use, the pilots 30 are continuously burning, ignition being effected, if required, by flame delivered through the igniter pipe 34.

The structure just described is satisfactory for installations where wind velocities are high such as in Alaska.

For some installations it is preferred to employ a flame shield 40 to hide the flame at low rates and to hide the flame from the view of persons in adjoining areas which includes a cylindrical ring 41 spaced outwardly from the flare pipe 10 to permit air for combustion to be induced therebetween. The ring 41 is supported from the pipe 10 by a plurality of circumferentially spaced plate brackets 42.

The ring 41 has extending upwardly therefrom a frusto-conical shield portion 43 diverging upwardly.

The mode of use will now be pointed out.

Combustible waste gas for combustion, delivered through the pipe 12, is directed outwardly in the arms 18 and passes upwardly through the slots 24 in a plurality of relatively flat radial streams to the mixing chamber 25.

Air under pressure delivered through the pipe 11 into the pipe 10, moves upwardly and along the exteriors of the arms 18, for contact with the radial streams, to the mixing chamber 25 where it mixes with the radial streams of combustible gas from the slots 24.

The partially mixed combustible gas and air from the mixing chamber 25 is directed in a vortex pattern with further mixing by the vanes 28 for ignition by the pilots 30 and combustion in an ascending vortex of cylindrical or flaring frusto-conical shape.

Air surrounding the ascending vortex is drawn thereinto to aid the burning. This air will be available through the space between the ring 41 and the pipe 10 if the shield 43 is used and also from above the shield 43 as the burning continues upwardly in the vortex pattern.

If the shield 43 is not used air surrounding the ascending vortex will be drawn inwardly to the flame to aid the burning.

The access of air to the vortex flame contributes to combustion without smoke.

It will thus be seen that apparatus is provided with which the objects of the invention are attained.

I claim:

1. A flare stack gas burner for combustible waste gas comprising a vertical stack pipe having a free upper end for combustion therebeyond, means for delivering primary air under pressure to the interior of the stack pipe for delivery to said upper end, a waste gas delivery pipe connected to a supply of waste combustible gas under pressure interiorly vertically centrally disposed in said stack pipe, said waste gas delivery pipe in spaced relation below said upper end of said stack pipe having a plurality of outwardly extending arms with spaces between said arms for upward movement of air, said arms having elongated discharge slot portions facing toward said upper end of said stack pipe for waste gas discharge therethrough and extending substantially the distance between said waste gas pipe and said stack pipe, and a fixedly mounted diffuser disposed at the upper end of said stack pipe, said diffuser being adjacent to and in vertically spaced relation to said arms to provide a pre-combustion waste gas and air mixing space therebetween, said diffuser comprising a central hub with a plurality of radially disposed titled vanes extending therefrom imparting a vortex pattern to the air and waste gas passing through said diffuser for turbulent burning therebeyond in a vortex pattern.

2. A flare stack gas burner as defined in claim 1 in which a flame shield is provided at the upper end of said stack pipe.

3. A flare stack gas burner as defined in claim 2 in which said flame shield comprises a ring portion spaced from said stack pipe for delivery of air for combustion between said ring and said stack pipe.

4. A flare stack gas burner as defined in claim 3 in which said ring has a diverging shield portion carried thereby.

* * * * *